US010160126B2

(12) United States Patent
Ranieri et al.

(10) Patent No.: US 10,160,126 B2
(45) Date of Patent: Dec. 25, 2018

(54) PROTECTIVE SHEATH FOR SECURING A BLADE OF A CUTLERY IMPLEMENT

(76) Inventors: Laura Ranieri, Palatine, IL (US); John Chap, Woodridge, IL (US); Nicholas S. Blair, Whitefish Bay, WI (US); Charles L. Lasky, Grafton, WI (US); Scott H. Micoley, Cedarburg, WI (US); Patrick Michael Kerulis, Chicago, IL (US)

( * ) Notice: Subject to any disclaimer, the term of this patent is extended or adjusted under 35 U.S.C. 154(b) by 220 days.

(21) Appl. No.: 12/639,660

(22) Filed: Dec. 16, 2009

(65) Prior Publication Data

US 2011/0139645 A1 Jun. 16, 2011

(51) Int. Cl.
*B26B 29/00* (2006.01)
*B26B 29/02* (2006.01)

(52) U.S. Cl.
CPC ..... *B26B 29/025* (2013.01)

(58) Field of Classification Search
CPC ..... F41B 13/04; F41C 27/18; B26B 29/00; B26B 29/025; B26B 29/02; B26B 3/06; A45F 2003/025
USPC ..... 206/349, 553, 207; 224/232; 30/151–164
See application file for complete search history.

(56) References Cited

U.S. PATENT DOCUMENTS

| | | | |
|---|---|---|---|
| 28,175 | A | 5/1860 | Hoffman |
| 675,252 | A | 5/1901 | Simmons |
| 831,770 | A | 9/1906 | Bragg |
| 831,771 | A | 9/1906 | Bragg |
| 1,108,864 | A | 8/1914 | Jennings |
| 1,123,862 | A | 1/1915 | Ellery |
| D52,037 | S | 5/1918 | Curtiss |
| 1,297,008 | A | 3/1919 | Pommer |
| 1,508,382 | A | 9/1924 | Chatillon |
| 1,593,935 | A | 7/1926 | Gerick et al. |
| 1,605,359 | A | 11/1926 | Louret |
| 1,812,302 | A | 6/1931 | Nies |
| 2,120,826 | A | 6/1938 | Young |
| D115,248 | S | 6/1939 | Cook |
| D133,851 | S | 9/1942 | Ehrsam |
| D133,985 | S | 10/1942 | Ehrsam |
| D138,571 | S | 8/1944 | Huff |
| 2,361,735 | A | 10/1944 | Beckwith et al. |
| D140,745 | S | 4/1945 | Fairbairn et al. |
| 2,387,900 | A | 10/1945 | Hartwell |
| 2,391,574 | A | 12/1945 | Housinger |
| 2,398,764 | A | 4/1946 | Bailey |
| 2,399,522 | A | 4/1946 | Tyson |
| 2,424,302 | A | 7/1947 | Brickey |
| 2,439,568 | A | 4/1948 | Hall |
| 2,500,525 | A | 3/1950 | Buigne |

(Continued)

FOREIGN PATENT DOCUMENTS

| | | | |
|---|---|---|---|
| AU | 2010202826 | B2 | 7/2016 |
| CA | 2719051 | C | 12/2014 |

*Primary Examiner* — Ernesto Grano
(74) *Attorney, Agent, or Firm* — Morgan, Lewis & Bockius LLP

(57) ABSTRACT

A protective sheath is provided for removably securing a blade within the sheath. The sheath includes walls forming a cavity to receive the sheath within the cavity. The sheath also includes a concave detent portion having at least one arm for removably and frictionally securing the blade within the sheath so as to prevent inadvertent or unintended removal of the blade from the sheath.

8 Claims, 11 Drawing Sheets

(56) References Cited

U.S. PATENT DOCUMENTS 2,517,649 A 8/1950 Frechtmann
2,527,710 A 10/1950 Davidson, Jr.
2,528,059 A 10/1950 Kendrick
2,528,501 A 11/1950 Davis
2,545,121 A 3/1951 Szopa
D167,591 S 8/1952 Schrade
2,618,057 A 11/1952 Gibson
2,650,008 A 8/1953 Morseth
D170,417 S 9/1953 Knapp
2,687,833 A 8/1954 Sutton
D178,043 S 6/1956 Douglass
2,767,530 A 10/1956 Paldanius
2,783,536 A 3/1957 McQueary
2,793,434 A 5/1957 Wigington
2,859,516 A 11/1958 McQueary
2,901,823 A 9/1959 Widen
2,903,171 A 9/1959 Rutledge, Jr.
2,910,216 A 10/1959 Bennett
3,008,617 A 11/1961 Villwock
3,044,673 A 7/1962 Manning
3,067,866 A 11/1962 Burton
3,130,834 A 4/1964 Korzaan
3,191,825 A * 6/1965 Beckwith ..... 224/232
3,227,268 A 1/1966 Gringer
3,241,237 A 3/1966 Eastman
3,246,813 A 4/1966 Miller
3,257,050 A 6/1966 Smith
3,269,009 A 8/1966 Eastman
D205,769 S 9/1966 Beckwith
3,278,020 A 10/1966 Murphy
3,307,756 A 3/1967 Brunosson et al.
3,363,813 A 1/1968 Eastman
3,381,807 A 5/1968 Vaughn
3,487,922 A 1/1970 Peck
3,514,022 A 5/1970 Eastman
3,521,810 A 7/1970 Boyer
3,524,570 A 8/1970 Seguine
3,533,540 A 10/1970 Carinci
D219,897 S 2/1971 Laughlin
3,576,278 A 4/1971 Eastman
3,651,928 A 3/1972 Weisman
3,676,961 A 7/1972 Jackson
D225,559 S 12/1972 Bayly
D230,847 S 3/1974 Beddick
3,841,541 A 10/1974 Griffis
3,891,088 A 6/1975 Huebner
3,958,330 A 5/1976 Hutchens
3,992,776 A 11/1976 Koppe et al.
D247,970 S 5/1978 Nordlund
4,114,787 A 9/1978 Rosenkaimer
D249,923 S 10/1978 Bayly
D250,824 S 1/1979 Bowers
D251,436 S 3/1979 Johnson
D251,569 S 4/1979 Johnson
4,178,681 A 12/1979 Hanses
D255,507 S 6/1980 Gingher, Jr.
4,211,003 A 7/1980 Collins
4,263,714 A 4/1981 Todd, Sr.
4,320,569 A 3/1982 Todd, Sr.
4,326,652 A 4/1982 Fortenberry
4,404,747 A 9/1983 Collins
4,414,744 A 11/1983 Collins
4,428,515 A 1/1984 Mayer
4,502,218 A 3/1985 Carter et al.
4,524,892 A 6/1985 Ozeki
D279,951 S 8/1985 Winyard
4,541,556 A 9/1985 Collins et al.
4,547,937 A 10/1985 Collins
D281,896 S 12/1985 DeMayo
4,558,516 A 12/1985 Collins
D289,913 S 5/1987 Ader
D291,626 S 9/1987 Collins
D291,627 S 9/1987 Collins
D292,752 S 11/1987 Reinhardt
4,726,498 A 2/1988 Esposito
D296,498 S 7/1988 Collins et al.
4,759,483 A 7/1988 Willoughby
4,794,738 A 1/1989 Brignoli
D299,807 S 2/1989 Sawa
4,803,745 A 2/1989 Izquierdo
4,805,350 A 2/1989 Farrer
4,805,818 A 2/1989 Harrison
4,805,819 A 2/1989 Collins
4,834,077 A * 5/1989 Sun ..... 600/186
D301,396 S 6/1989 Finn
4,835,863 A 6/1989 Salandre
D303,001 S 8/1989 Su
4,854,044 A 8/1989 Collins
4,856,192 A 8/1989 Collins
4,869,027 A 9/1989 McEvily
D303,731 S 10/1989 Blochlinger et al.
4,942,663 A 7/1990 Ray, Sr.
4,961,523 A 10/1990 Stimac
4,964,554 A 10/1990 Collins
4,998,350 A 3/1991 Thompson
5,002,213 A 3/1991 Newton et al.
5,009,348 A 4/1991 Derkatz
D317,037 S 5/1991 Koshiishi
5,031,810 A 7/1991 Finn et al.
D321,548 S 11/1991 Collins
5,067,239 A 11/1991 Collins
5,092,046 A 3/1992 Collins
5,115,953 A 5/1992 Werner
5,123,167 A 6/1992 Kelley
5,138,768 A 8/1992 Collins
5,146,684 A 9/1992 Hagler
D330,491 S 10/1992 Worsfold et al.
5,155,911 A 10/1992 Collins
5,163,592 A 11/1992 Newton et al.
D332,871 S 2/1993 Seber
D332,872 S 2/1993 Seber
D333,213 S 2/1993 Seber
D333,728 S 3/1993 Seber
D334,791 S 4/1993 Collins
5,211,322 A 5/1993 Nealy
D339,963 S 10/1993 Roberts et al.
5,255,436 A 10/1993 Yoshida
D341,753 S 11/1993 Winyard
D344,675 S 3/1994 Jacobson
5,291,996 A * 3/1994 Linden ..... 206/349
5,297,341 A 3/1994 Collins
5,315,761 A 5/1994 Norton et al.
D352,823 S 11/1994 Chapman et al.
5,363,957 A 11/1994 Reichner
5,375,700 A 12/1994 Joss et al.
5,379,520 A 1/1995 Collins
D367,513 S 2/1996 Blumberg
D368,951 S 4/1996 Buck et al.
D369,673 S 5/1996 Morton et al.
D374,981 S 10/1996 Hainsworth et al.
5,568,888 A 10/1996 Seber
5,572,793 A 11/1996 Collins et al.
D378,243 S 3/1997 Seber
5,647,130 A 7/1997 Collins
D383,961 S 9/1997 Scales, III
D384,724 S 10/1997 Uke et al.
5,699,907 A 12/1997 Langenstuck
5,706,941 A 1/1998 Erisoty
5,711,079 A * 1/1998 Fischer et al. ..... 30/342
D390,767 S 2/1998 Scales, III
5,772,027 A 6/1998 Pletz
5,794,347 A 8/1998 Serpa
D405,954 S 2/1999 Liu
5,915,793 A 6/1999 Serpa
D411,948 S 7/1999 Chipperfield
5,926,959 A 7/1999 Collins
D414,330 S 9/1999 Eriksson et al.
D418,054 S 12/1999 Zirbes
D424,906 S 5/2000 May et al.
D429,122 S 8/2000 Stokes
6,138,363 A 10/2000 Kawashima
D433,882 S 11/2000 Neshat et al.
D435,400 S 12/2000 Veltz et al.
D443,759 S 6/2001 Bloch

(56) References Cited

U.S. PATENT DOCUMENTS

| | | | |
|---|---|---|---|
| D448,442 | S | 9/2001 | Cheng |
| 6,293,448 | B1 | 9/2001 | Pietrusynski |
| 6,308,419 | B1 | 10/2001 | Neshat et al. |
| D457,310 | S | 5/2002 | Aberman |
| 6,427,333 | B1 | 8/2002 | Veltz et al. |
| 6,427,340 | B1 | 8/2002 | Cohen |
| 6,434,838 | B1 | 8/2002 | Mai |
| 6,442,843 | B1 | 9/2002 | Jue et al. |
| 6,457,239 | B1 | 10/2002 | McLaughlin |
| 6,457,240 | B1 | 10/2002 | Liu |
| D465,542 | S | 11/2002 | Bloch |
| D465,916 | S | 11/2002 | Shaver et al. |
| 6,493,946 | B1 | 12/2002 | Carrillo |
| D476,394 | S | 6/2003 | Trbovich, Jr. |
| D476,478 | S | 7/2003 | Kanzawa |
| 6,634,503 | B2 | 10/2003 | Welsh, Jr. |
| D482,788 | S | 11/2003 | Montgomery et al. |
| D483,123 | S | 12/2003 | Montgomery et al. |
| D490,153 | S | 5/2004 | Montgomery et al. |
| D491,622 | S | 6/2004 | Hadley et al. |
| D501,080 | S | 1/2005 | Tran |
| 6,840,416 | B2 | 1/2005 | Aberman |
| 6,901,668 | B2 | 6/2005 | Elsener-Zehnder et al. |
| D508,317 | S | 8/2005 | Kanzawa |
| 6,926,143 | B1 * | 8/2005 | Chen ..... 206/378 |
| 6,964,100 | B1 | 11/2005 | Musland |
| D514,187 | S | 1/2006 | Pedemonte |
| D514,312 | S | 2/2006 | Kanzawa |
| D518,952 | S | 4/2006 | Tran |
| 7,080,456 | B2 | 7/2006 | Wu |
| 7,086,156 | B2 | 8/2006 | McLaughlin |
| 7,175,023 | B2 | 2/2007 | Martin |
| D540,032 | S | 4/2007 | deDoes |
| D542,029 | S | 5/2007 | Schmidt |
| D542,525 | S | 5/2007 | Schmidt |
| D554,854 | S | 11/2007 | Curtin |
| 7,434,316 | B2 | 10/2008 | Nenadic |
| 7,469,475 | B2 | 12/2008 | Wong |
| D591,040 | S | 4/2009 | Foster et al. |
| 2002/0095792 | A1 | 7/2002 | Jue et al. |
| 2002/0113104 | A1 | 8/2002 | Levsen |
| 2002/0133952 | A1 | 9/2002 | Kenny |
| 2002/0152617 | A1 | 10/2002 | Liu |
| 2002/0153395 | A1 | 10/2002 | Martinez |
| 2003/0116681 | A1 | 6/2003 | Bullinger |
| 2004/0221457 | A1 | 11/2004 | Shen |
| 2005/0204565 | A1 | 9/2005 | Wong |
| 2008/0006660 | A1 | 1/2008 | Scheiter |
| 2008/0264992 | A1 | 10/2008 | Westling |
| 2009/0065386 | A1 | 3/2009 | Hasegawa |

* cited by examiner

10

90
94
92
32
44
36
38
42
40
26
82
80
84

10

90
94
92
52
62
56
57
64
34
60
55
54
62
66
36
38
82
80
84

FIG. 11
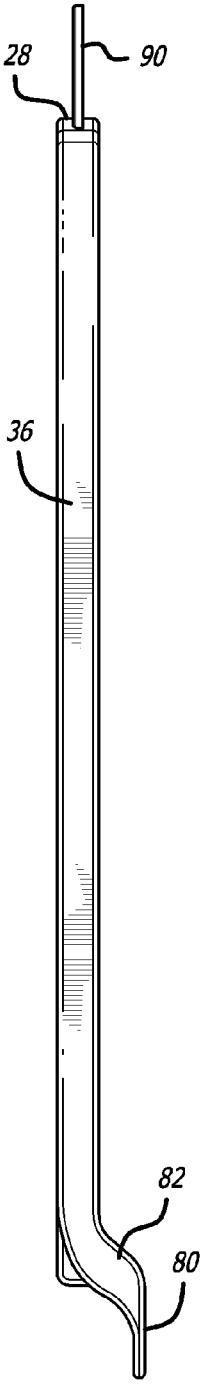
FIG. 12
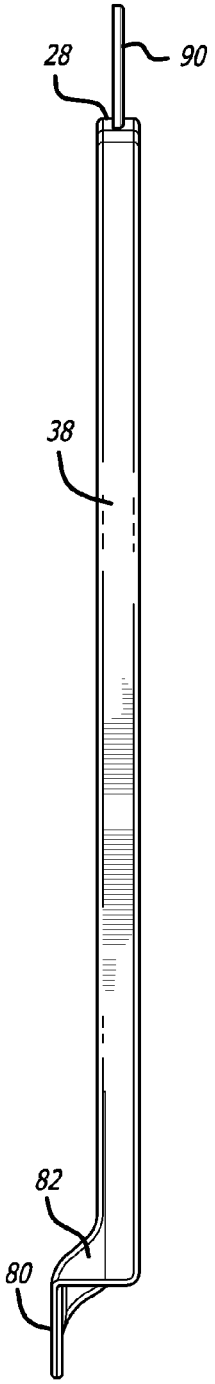
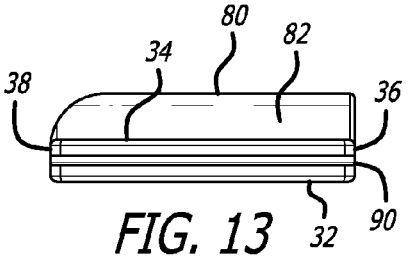
FIG. 13
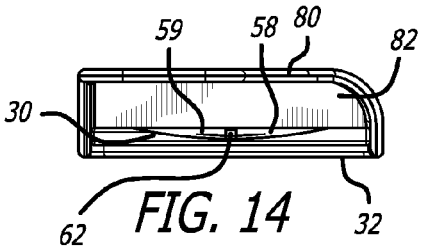
FIG. 14

PROTECTIVE SHEATH FOR SECURING A BLADE OF A CUTLERY IMPLEMENT

TECHNICAL FIELD

The present subject matter relates to a protective sheath for a cutlery blade, and more particularly, to a unitary sheath with an integral securing structure.

BACKGROUND

Sheaths for blades have been provided to store blades of kitchen cutlery, kitchen tools and various other implements. Such sheaths have included various structurally independent mechanisms for securing blades within the sheaths, such as straps, clips and clamps. Other sheaths have been provided in shapes that are difficult or expensive to manufacture.

A fold-over sheath is known in which a sheath is formed by folding over a sheet of material to form two halves, i.e., a top half and a bottom half. The fold-over sheath includes a closed side where the sheet has been folded and an open side where two ends of the sheet meet to form a top edge and a bottom edge. The open end where the top and bottom edges meet is configured to hold a blade between the edges.

One disadvantage of such a fold-over sheath is that the top and bottom edges are configured to engage a blade positioned therein along a side of the blade near the edge of the blade. such a configuration can results in a loose grip on the blade, particularly in instances wherein a thin cutting edge of the blade is secured between the top and bottom edges of the fold-over sheath. Another disadvantage of the fold-over sheath is that forces applied by the blade to the fold-over seam formed in the sheath sidewall may cause the separation of the folded members and inadvertently expose the blade to the user. Even proper orientation of the blade within the fold-over sheath does not ensure that the blade will be secured in a way that prevents inadvertent sliding of the blade from the sheath due to the opening between the top and bottom edges. Hence a need exists for a single unitary sheath which removably secures blades within the sheath without added components or parts and in a shape which provides ease of manufacture and reduces expense associated with same. A need also exists for a single unitary sheath which prevents inadvertent sliding or removal of the blade from the sheath.

The present invention is provided to solve the problems discussed above and other problems, and to provide advantages and aspects not previously provided. A full discussion of the features and advantages of the present invention is deferred to the following detailed description, which proceeds with reference to the accompanying drawings.

SUMMARY

According to the present invention, a protective sheath for removably securing a blade is provided. In one example, the sheath includes a unitary body having a proximal end and a distal end. The sheath comprises a cavity formed by a first wall, a second wall extending from the first wall, a third wall extending from the second wall and a fourth wall extending from the third wall. The first wall is substantially parallel to the third wall and connects the fourth wall to the second wall. The second wall connects the first wall to the third wall. The third wall connects the second wall to the fourth wall and the fourth wall connects the third wall to the first wall. The sheath also includes an end wall at the distal end of the body and an opening formed proximate the proximal end of the body. The opening formed proximate the proximal end of the body is configured to receive a blade into the body. The sheath also includes a concave detent defined in the second wall that extends into the cavity for frictionally securing a blade inserted into the cavity. The concave detent extends from a position adjacent the end wall to a position adjacent the opening and includes at least one arm formed by at least one aperture in the concave detent.

According to another aspect of the invention, the sheath includes a molded thermoplastic body having a proximal end and a distal end. The body comprises a cavity for receiving a blade. The cavity is formed by a first wall, a second wall, a third wall and a fourth wall. The first and third walls are substantially parallel to each other and the second and fourth walls are substantially parallel to each other. The second and fourth walls are also substantially transverse to the first and third walls. The first, second, third and fourth walls are connectedly arranged to form a substantially rectangular cross-section. The sheath includes an end wall at the distal end of the cavity and an opening formed proximate the proximal end of the body. The opening is configured to receive a blade into the body of the sheath. A concave portion is defined in one of either the second wall and the fourth wall. The concave portion extends into the cavity and is configured to frictionally engage a blade inserted into the cavity. The concave portion extends from the end wall to the opening and includes at least two arms formed by at least one aperture in the concave portion.

According to another aspect of the invention, the concave portion is defined in only one of either the second wall and the fourth wall. In yet another example, the sheath includes an extension tab extending from the proximal end of the body and having formed therein at least one aperture configured to receive a handle securing member. In yet a further example, the sheath includes a display tab extending from the distal end of the body and having formed therein an aperture for placement of the sheath on a display. The display tab may be removably attached to the body.

Additional advantages and novel features will be apparent to those skilled in the art from the following descriptions and the accompanying drawings.

BRIEF DESCRIPTION OF THE DRAWINGS

The drawing figures depict one or more examples in accord with the present teachings, by way of example only, not by way of limitation. In the figures, like reference numerals refer to the same or similar elements.

FIG. 11 is a left side view of the cutlery sheath shown in FIG. 8.

FIG. 12 is a right side view of the cutlery sheath shown in FIG. 8.

FIG. 13 is a top view of the cutlery sheath shown in FIG. 8.

FIG. 14 is a bottom view of the cutlery sheath shown in FIG. 8.

Figure 1:
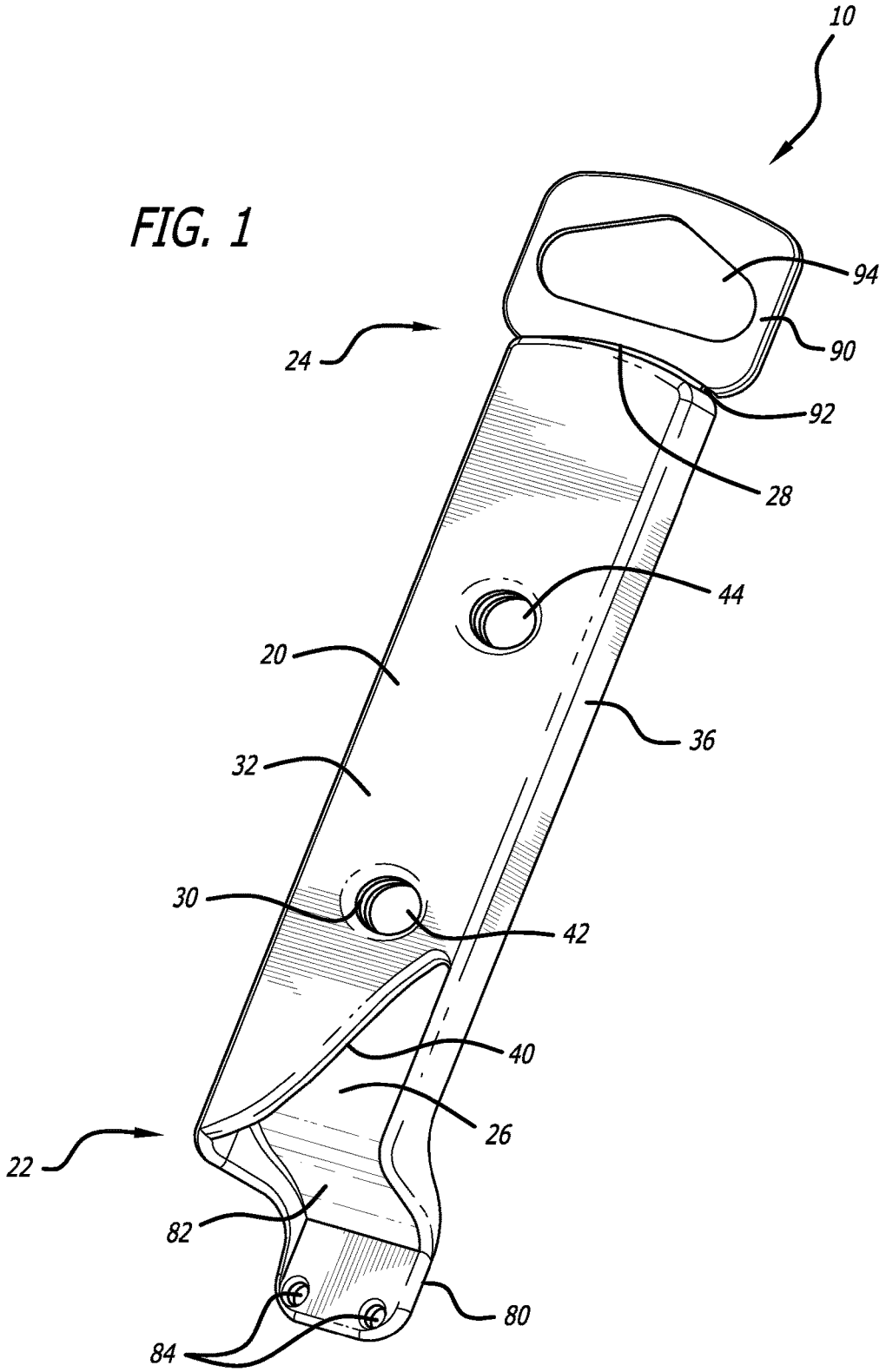
FIG. 1 is a perspective view of one example of a cutlery sheath according to the present disclosure.
Figure 2:
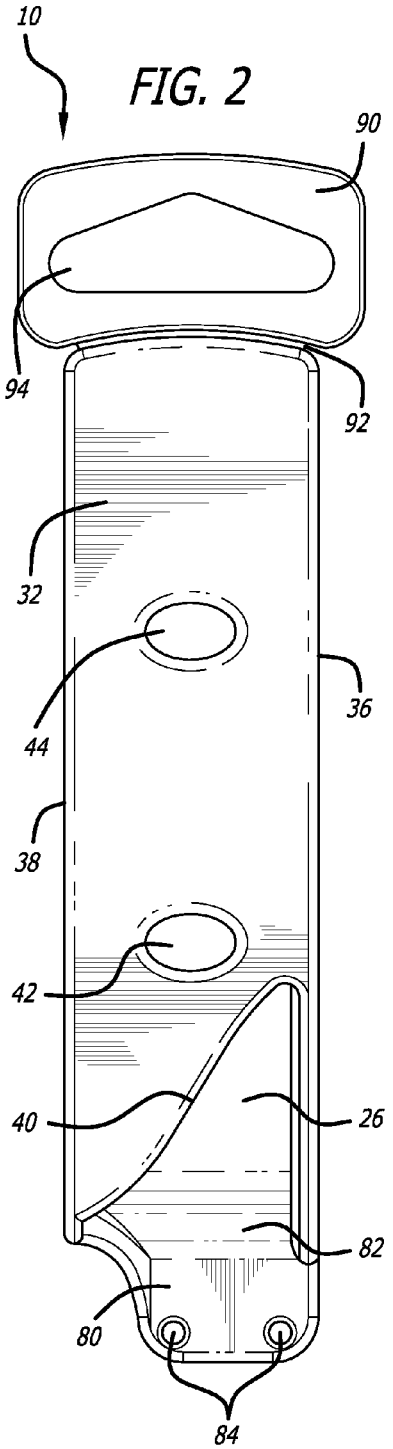
FIG. 2 is a front view of the cutlery sheath shown in FIG. 1.

The components in the drawings are not necessarily to scale, emphasis instead being placed upon clearly illustrating the principles of the present invention.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present disclosure relates to a protective sheath for removably securing a blade, such as the blade of a cutlery item or similar implement. The sheath of the present disclosure provides a convenient display package for retail or commercial use, while also providing a convenient storage device. The sheath is preferably formed as a unitary body, which includes a cavity for receiving the blade within the sheath. The sheath protects the blade from being exposed while not in use in an effort to minimize safety risks (e.g., potential lacerations of users attempting to retrieve the blade from a drawer, cabinet, tool box, or other storage area). The sheath also secures the blade in such a way as to avoid inadvertent or unintended removal of the blade from the sheath. The sheath includes a concave detent formed in the body of the sheath having at least one arm that extends into the cavity to removably secure the blade within the sheath. The concave detent and arm are formed to engage proximate the center of the blade to prevent inadvertent or unintentional removal or sliding of the blade from the sheath. Because the concave detent and arm engage the center of the blade, the sheath accommodates insertion and positioning in various orientations. Accordingly, the blade will be removably secured, but also prevented from inadvertent or unintentional removal or sliding out from the sheath. The concave detent and arm are formed in such a way as to be continuously and integrally formed as part of the body of the sheath, which simplifies manufacturing as the sheath can be formed (e.g., molded) as a single piece, rather than manufactured as a collection of separate components secured together. In addition, the sheath is formed in a simple shape.

Reference now is made in detail to the examples illustrated in the accompanying drawings and discussed below. One example of the protective sheath of the present disclosure is shown in FIGS. 1-7. A protective sheath 10 for removably securing a blade is shown. the protective sheath 10 includes a body 20 having a proximal end 22 and a distal end 24. The body may be formed of thermoplastic material, for example, polypropylene, polyethylene, nylon, various styrenes, or copolymers or blends thereof, and is preferably formed of polypropylene. Other polymer resins may also be used and the present disclosure should not be limited to a particular material. The body 20 includes a front wall 32, back wall 34, first and second sidewalls 36, 38, respectively, and an end wall 28 formed at the distal end of the body 20. It is noted that the designation of "front," "back," "first," "second" and "end" should not be construed as limiting and are merely used for ease of explanation. An opening 26 is formed at the proximal end of the body 20. The opening 26 is configured to receive blades of various dimensions and thicknesses, which the sheath is capable of removably securing therein.

A cavity 30 is defined in the body 20 by the front wall 32, back wall 34, first sidewall 36 and second sidewall 38. The cavity 30, defined by the front wall 32, back wall 34, and first and second sidewalls 36, 38 is configured to receive blades of various dimensions and thicknesses in either left-handed or right-handed configuration. For example, a knife having a blade with a single cutting edge may be placed inside the sheath with the cutting edge facing either toward the first sidewall 36 or the second sidewall 38. The end wall 28 closes the cavity at the distal end of the body 20. The walls of the body 20 prevent exposure of the cutting edge or point of a blade when placed within the cavity 30 such that a user is protected from lacerations from the blade when grasping or handling the sheath 10.

In one embodiment, the front wall 32 can include a cut-away contoured portion 40 at the proximal end 22. For example, the contoured portion 40 may serve to indicate which direction to place the cutting edge of a blade within the sheath 10. In one example, the cutting edge is positioned to face side wall 38 to ensure that none of the cutting edge is exposed. The contoured portion 40 also allows for the blade to be placed farther within the cavity 30 of the body 20 before the blade bolster or guard comes into contact with the contoured portion 40. Apertures 42, 44 may also be formed in the front wall 32. The apertures 42, 44, may facilitate placement of the blade inside the sheath by reducing the surface area contacting the blade as the blade slides into the sheath. The apertures 42, 44 also aid in drainage of the sheath when wet or damp blades are placed in the sheath, for example, after washing. The apertures may also facilitate handling of the sheath during manufacture.

Figure 3:
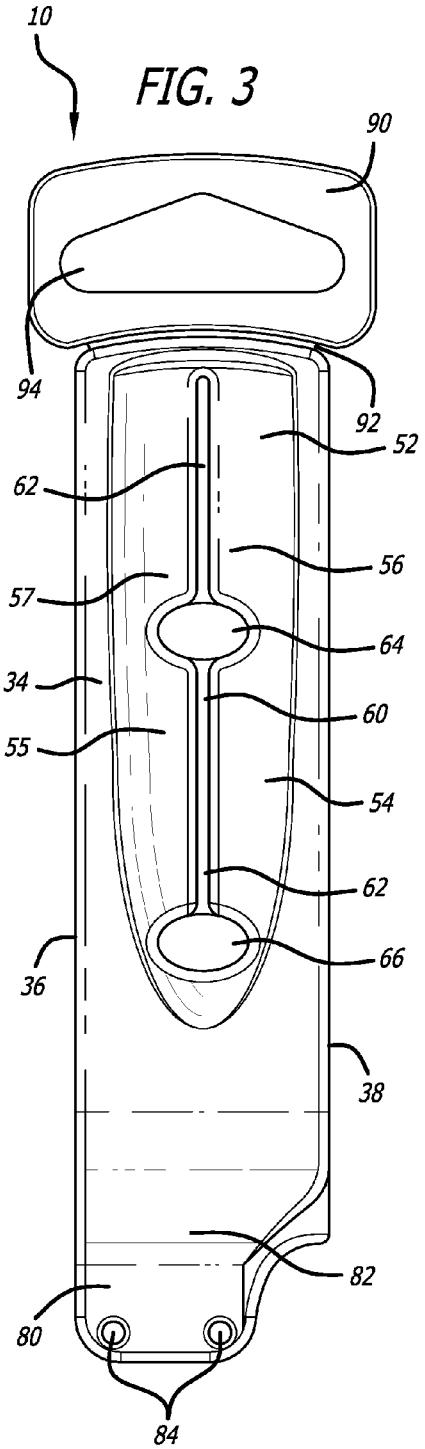
FIG. 3 is a rear view of the cutlery sheath shown in FIG. 1.
Figure 4:
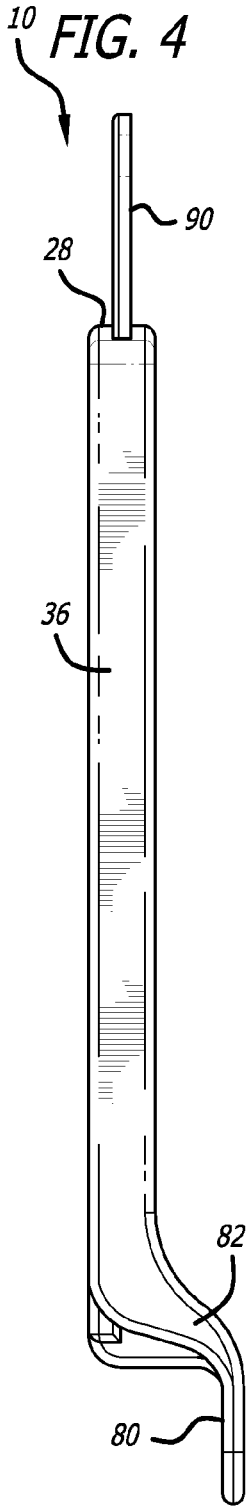
FIG. 4 is a left side view of the cutlery sheath shown in FIG. 1.
Figure 5:
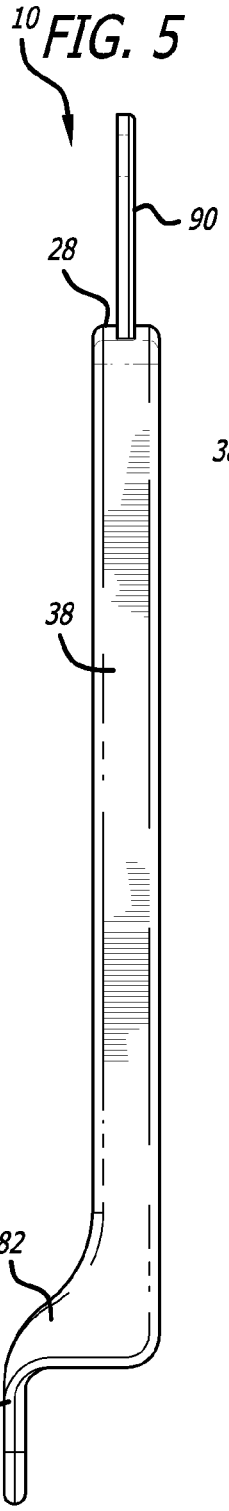
FIG. 5 is a right side view of the cutlery sheath shown in FIG. 1.
Figure 6:
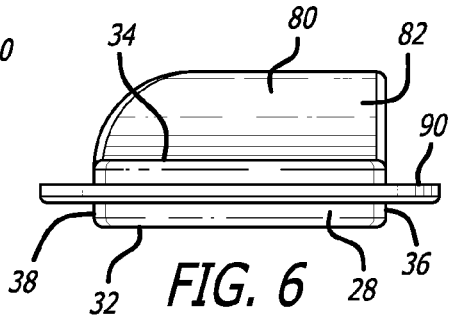
FIG. 6 is a top view of the cutlery sheath shown in FIG. 1.
Figure 7:
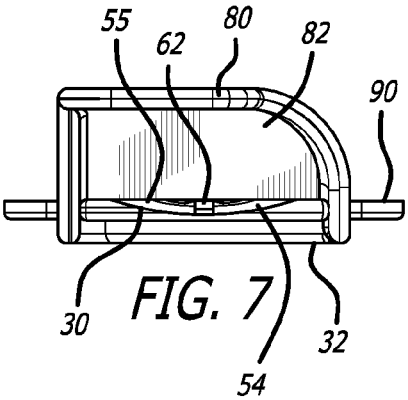
FIG. 7 is a bottom view of the cutlery sheath shown in FIG. 1.
Figure 8:
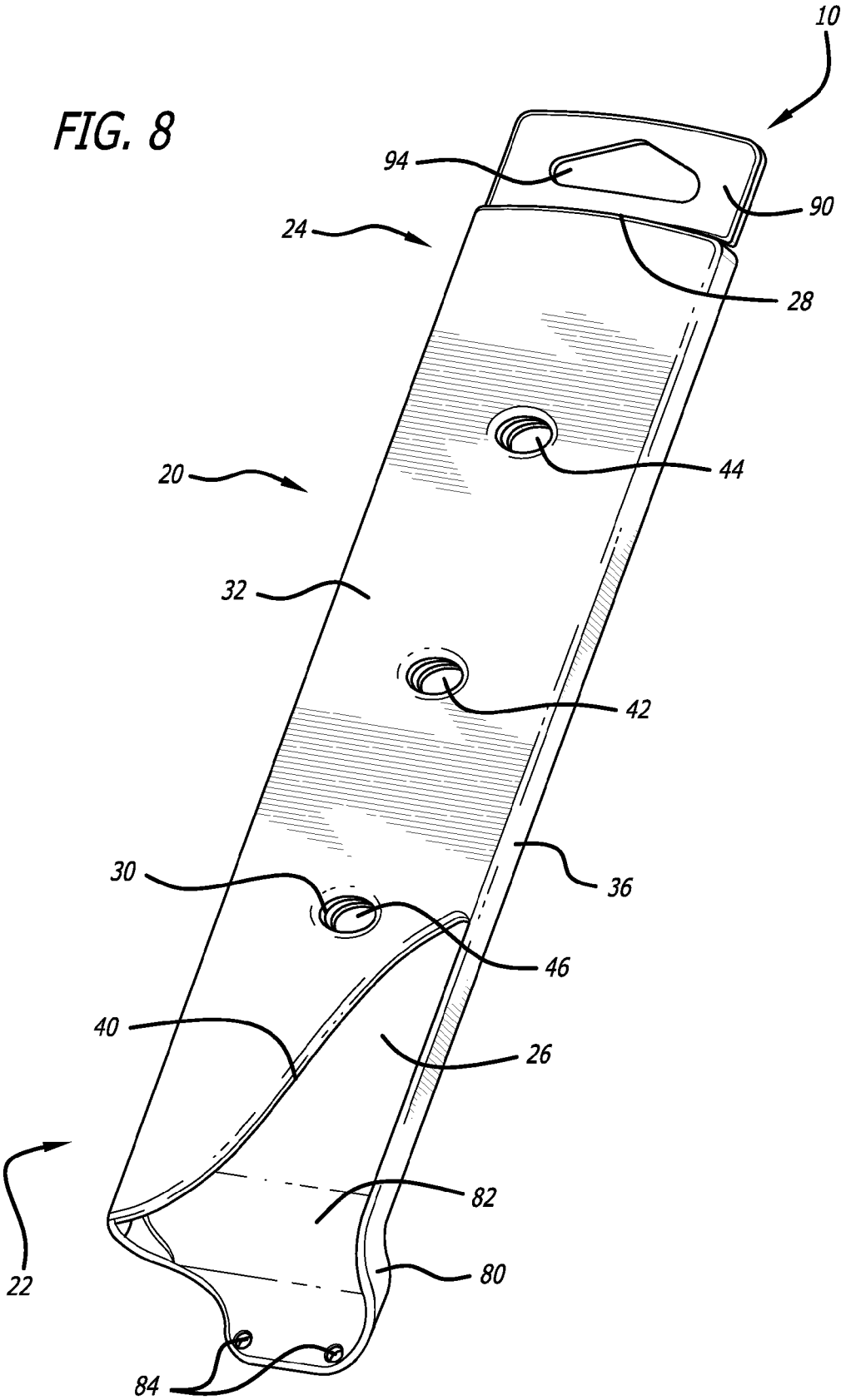
FIG. 8 is a perspective view of another example of a cutlery sheath according to the present disclosure.
Figure 9:
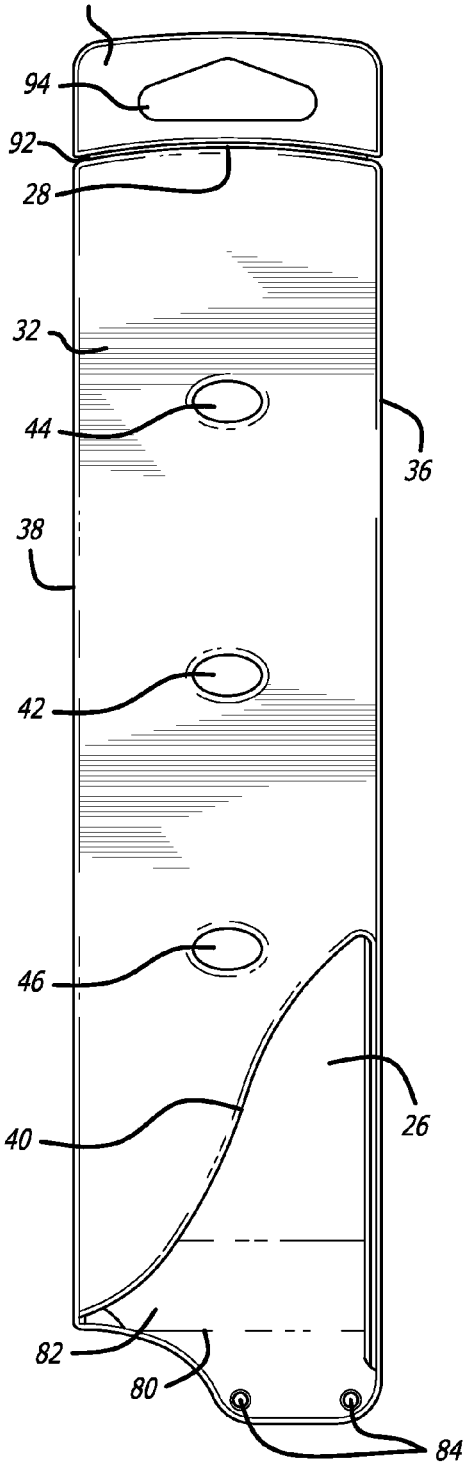
FIG. 9 is a front view of the cutlery sheath shown in FIG. 8.
Figure 10:
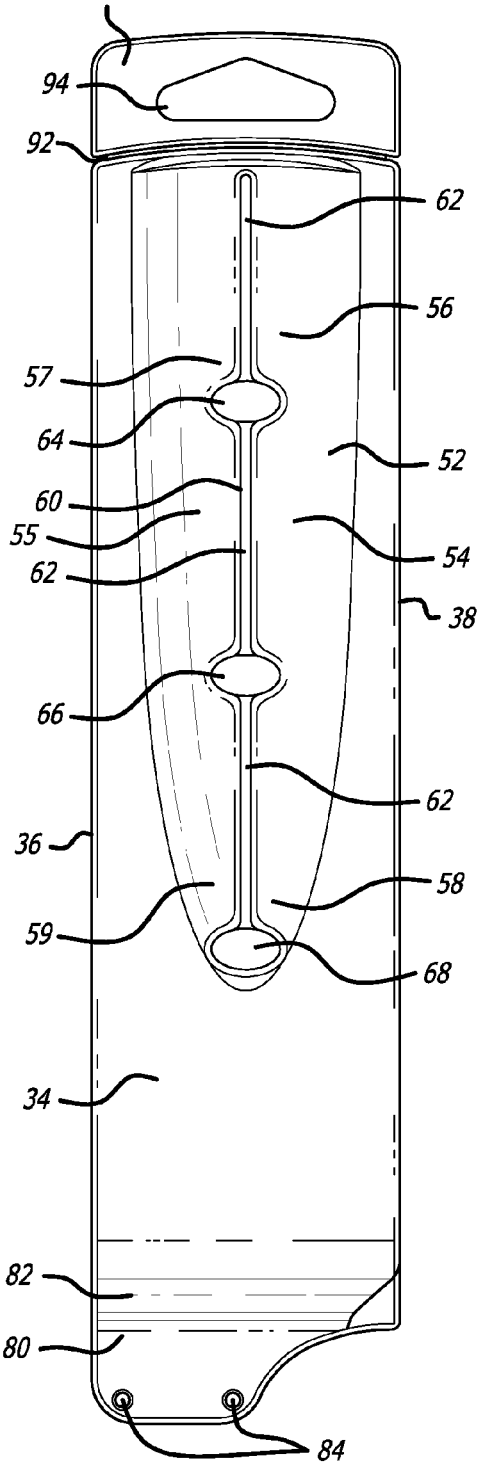
FIG. 10 is a rear view of the cutlery sheath shown in FIG. 8.
Figure 15:
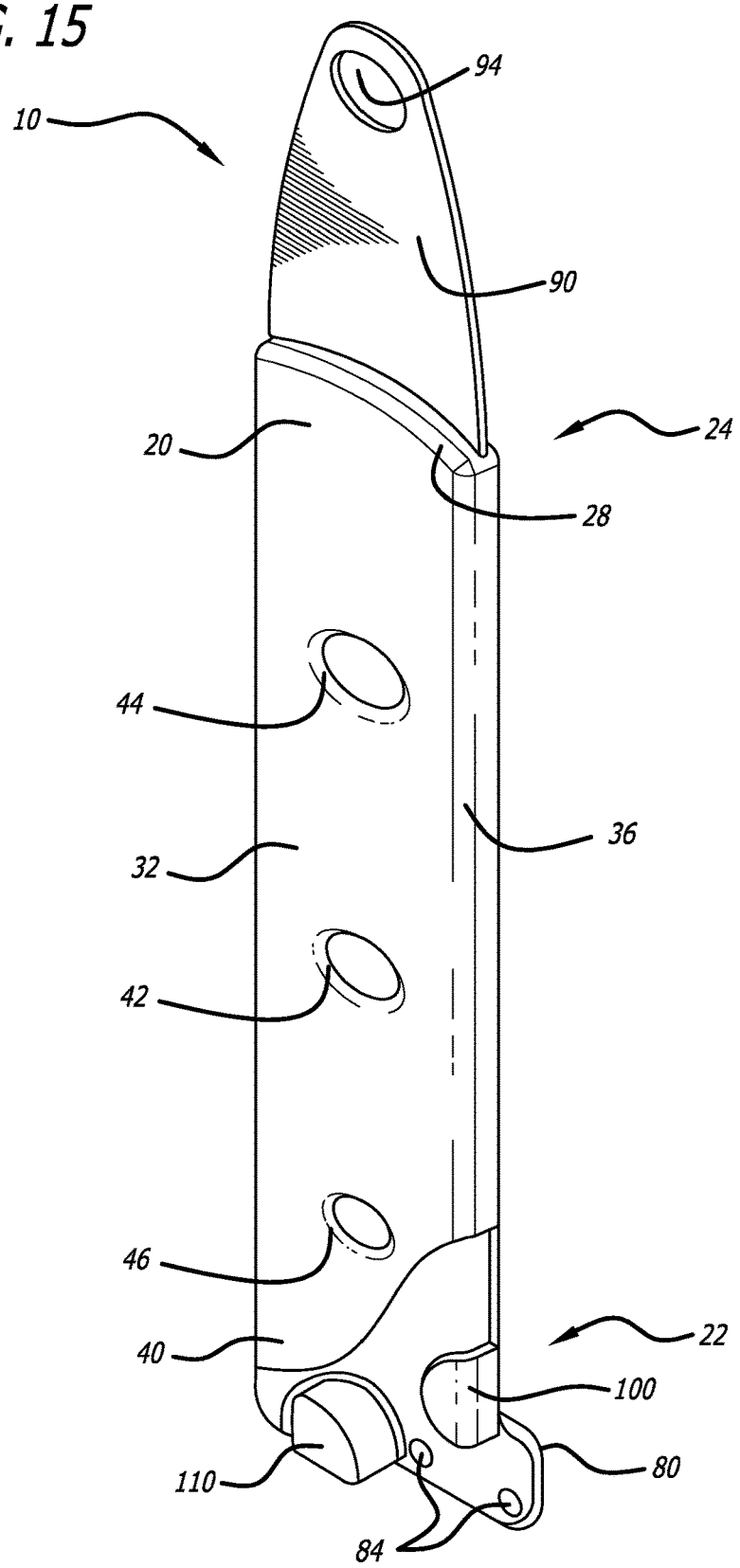
FIG. 15 is a perspective view of a further example of a cutlery sheath according to the present disclosure.
Figure 16:
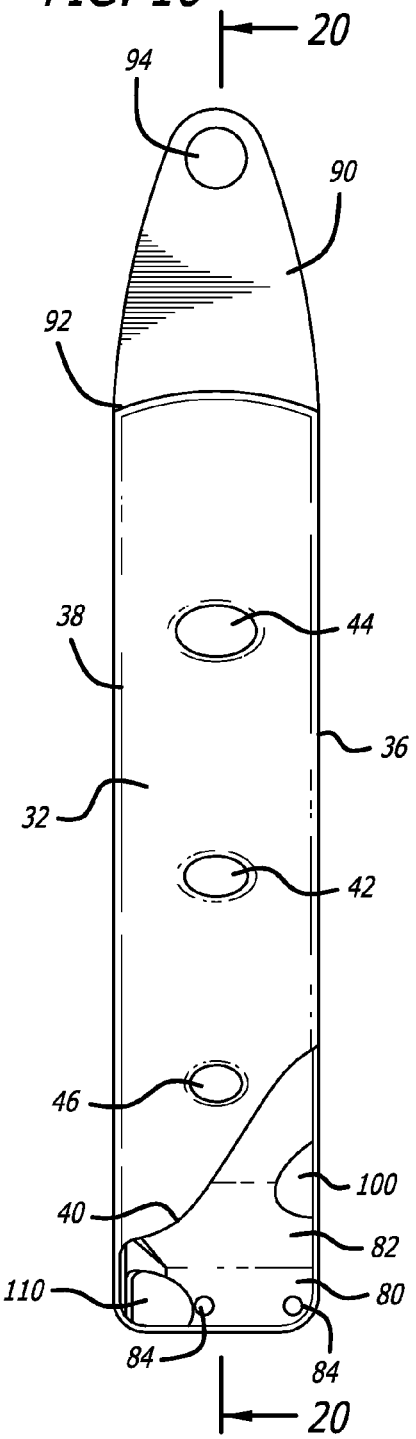
FIG. 16 is a front view of the cutlery sheath shown in FIG. 15.
Figure 17:
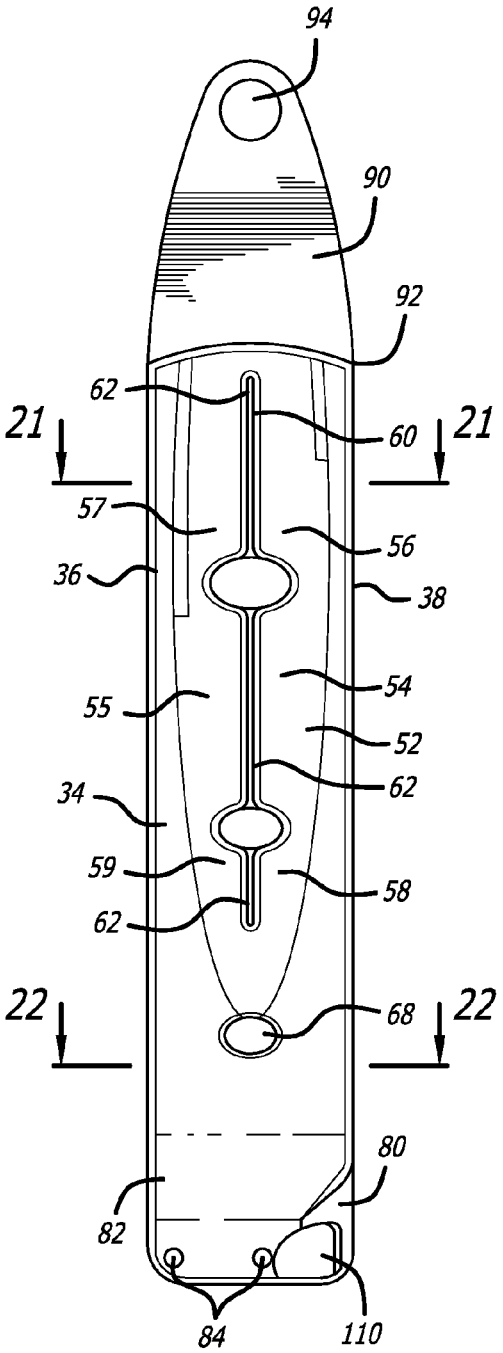
FIG. 17 is a rear view of the cutlery sheath shown in FIG. 15.
Figure 18:
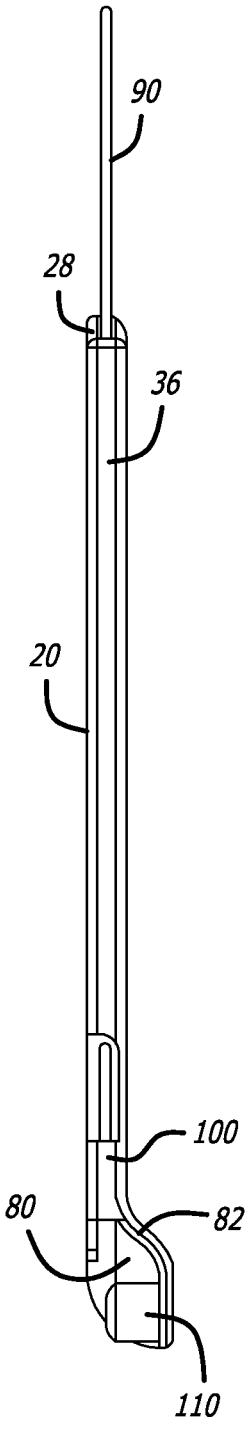
FIG. 18 is a left side view of the cutlery sheath shown in FIG. 15.
Figure 19:
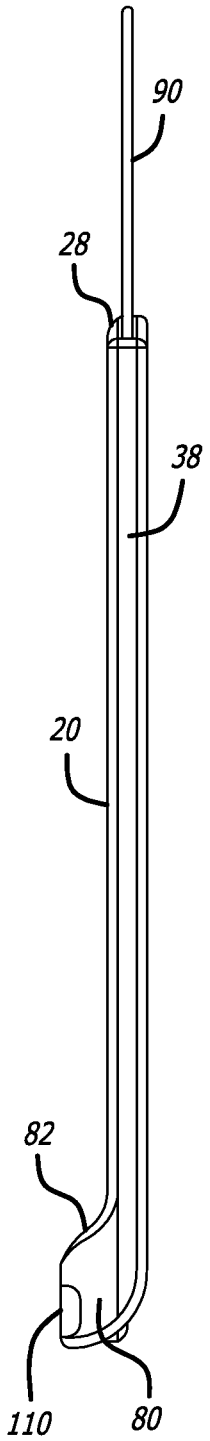
FIG. 19 is a right side view of the cutlery sheath shown in FIG. 15.
Figure 20:
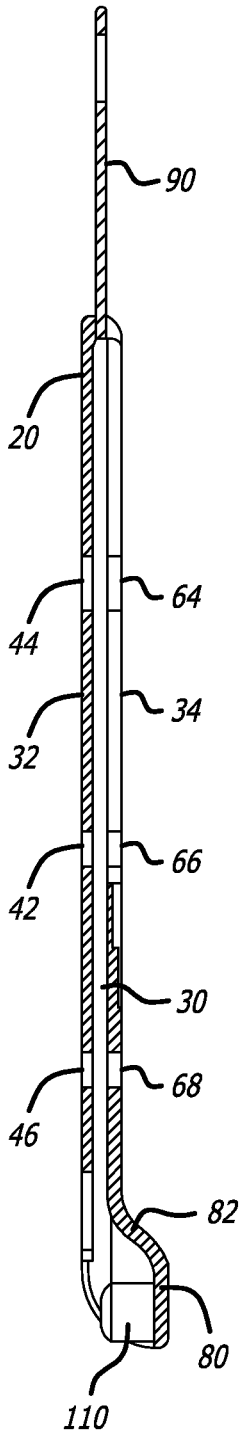
FIG. 20 is a cross-sectional view taken along line D-D shown in FIG. 16.
Figure 21:
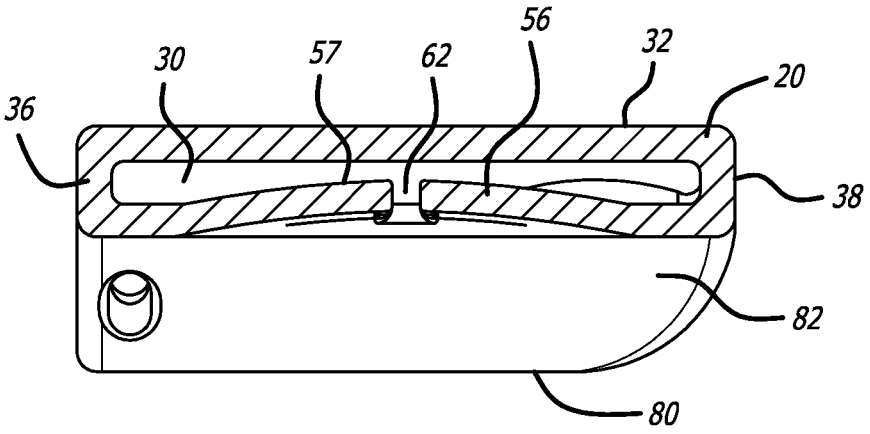
FIG. 21 is a cross sectional view taken along line A-A and viewed in the direction of the arrows as shown in FIG. 17.
Figure 22:
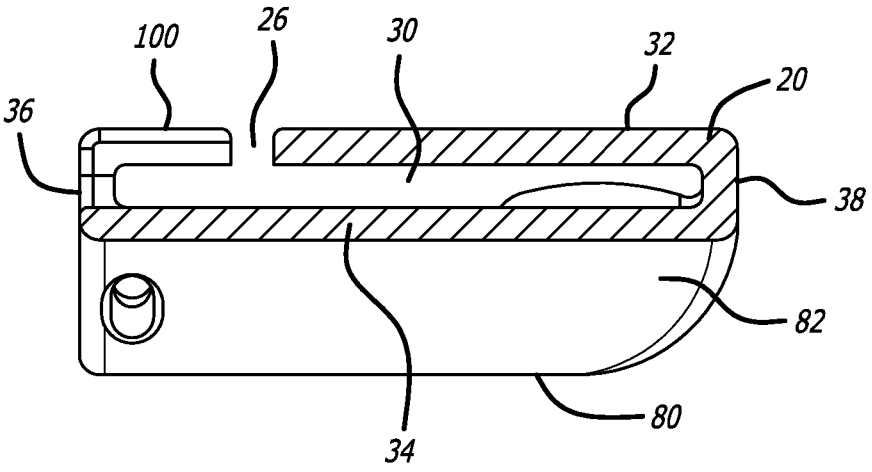
FIG. 22 is a cross sectional view taken along line B-B and viewed in the direction of the arrows as shown in FIG. 17.

As shown in FIGS. 3 and 7, the back wall 34 includes a concave detent portion 52 that extends from the back wall 34 into the cavity 30. The concave detent portion 52, as shown, generally extends from a position adjacent the distal end 24 of the body 20 to a position adjacent the opening 26 and extends along the center portion of the back wall 34. The concave detent portion 52 is configured to engage a blade placed within the body 20 through pressing friction, thus removably securing the blade within the cavity 30 by pressing the blade against the front wall 32. The concave detent portion 52 includes an arm 54 formed by an aperture 60 in the back wall 34. Because the arm 54 forms a portion of the concave detent portion 52, the arm 54 follows the contour of the concave detent portion 52. The arm 54 is also configured to frictionally engage and press against a blade disposed within the body, thus removably securing the blade therein. The concave detent portion 52 may also be provided with additional arms, for example, arm 55 is formed opposite to arm 54 and arms 56, 57 formed in the concave detent portion 52.

Figure 24:
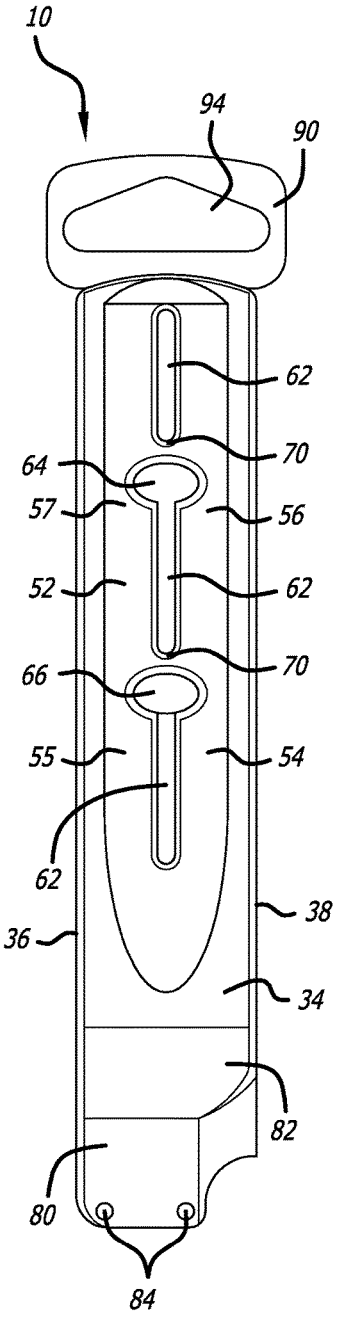
FIG. 24 is a rear view of the cutlery sheath shown in FIG. 23.

As shown in FIGS. 3 and 7, the arms 54, 55, 56, 57 are formed in the concave detent portion 52 by an aperture 60. The aperture 60 can include a longitudinal aperture 62 and end apertures 64, 66, joined, or disposed within close proximity, to create arm 54. As shown in FIG. 3, two end apertures 64, 66 are formed in the concave detent portion 52 which are connected by longitudinal aperture 62. As shown in FIG. 24, the longitudinal aperture 62 may be discontinuous and separated by bridges 70 formed above apertures 64, 66, respectively. The bridge 70 prevents a blade tip from leading out of the aperture (64 or 66) and into longitudinal aperture 62 as the blade is positioned within the sheath. The bridges 70 also help to maintain pressure on the blade surface. As with apertures 42, 44 of the front wall 32, the apertures formed in the back wall 34 may also aid in drainage of the sheath when wet or damp blades are placed in the sheath, for example, after washing. The apertures may also facilitate handling of the sheath during manufacture. Of course, various permutations of the arms and apertures may be included in the concave detent portion 52, some of which are discussed in various examples herein, to removably secure a blade within the sheath 10.

According to one embodiment, the sheath 10 is provided with an extension tab 80 that extends from the proximal end 22 of sheath 10. As shown in FIGS. 1-5, the extension tab 80 is offset from the back wall 34 by a lateral wall portion 82, which extends laterally from the proximal end 22 of the body 20. The lateral wall 82 connects the extension tab 80 to the back wall 34. The extension tab is formed with at least one aperture 84 for receiving a handle securing member (not shown), such as a strap or tie therethrough. The securing member acts to secure the handle of the cutlery implement to the sheath 10. The securing member also prevents removal of the blade from the sheath 10 unless and until the securing member is broken, cut, or otherwise removed or unfastened from the sheath 10. Conveniently, the securing member may be placed on the sheath and handle after assembly of the blade and sheath 10 to secure the handle and blade within the sheath for shipment and eventual display in a retail or commercial setting.

The sheath 10 also includes a display tab 90 extending from the distal end 24 of the body 20. The display tab 90 is connected to the end wall 28 of the sheath 10 by a connecting hinge 92. Perforations can be formed in the connecting hinge 92 to allow the display tab 90 to be removed from the sheath body 20. The connecting hinge 92 allows the display tab 90 to move relative to the body 20. The display tab also includes at least one aperture 94 for placement of the sheath 10 on a display (not shown), such as a display rack or other suitable structure for engaging the display tab 90 via aperture 94. As shown in the drawings, display tabs may be modified for the intended display rack or other suitable structure for displaying sheath 10. For example, more than one aperture may be provided in tab 90.

Turning to the examples illustrated in FIGS. 8-14, 15-22 and 23-25, like components illustrated in FIGS. 1-7 have been designated with like reference numerals. Detailed discussion of similar components as that discussed above in FIGS. 1-7 have been abbreviated or not discussed with the understanding that similar components will have the same or similar properties and functions as described above.

In another example of the present disclosure, as shown in FIGS. 8-14, a sheath 10 includes a unitary body 20 having a different dimension from the sheath 10 and body 20 shown in FIGS. 1-7. As a result, the body 20 and cavity 30 formed therein are configured to removably secure blades of different dimensions than that shown in FIGS. 1-7. The front wall 32 of the body 20 includes aperture 46 in addition to apertures 42, 44. The back wall 34 of the body 20 includes arms 58, 59 in addition to arms 54, 55, 56, 57 formed in the concave detent portion 52. The arms 58, 59 are formed by longitudinal aperture 62 and end apertures 64, 66, 68.

A further example of the present disclosure is shown in FIGS. 15-22. A sheath 10 includes a unitary body 20 having a different dimension from the sheaths previously discussed. In addition, the sheath 10 illustrated in FIGS. 15-22 includes a guide member 100 formed at the proximal end 22 of the body 20 adjacent the opening 26. The guide member 100 aids in placement of a blade within the sheath 10 while helping to secure the blade within the sheath 10. The sheath 10 also includes a shoulder 110 extending from the extension tab 80. The shoulder 110 engages the guard of the blade once the blade is positioned within the sheath 10. While the shoulder 110 and guide member 100 provide an additional level of engagement for the blade, it is understood that the concave detent and arms described and shown herein are configured to removably secure a blade within the sheath 10 without the aid of the shoulder 110 and guide member 100.

Figure 23:
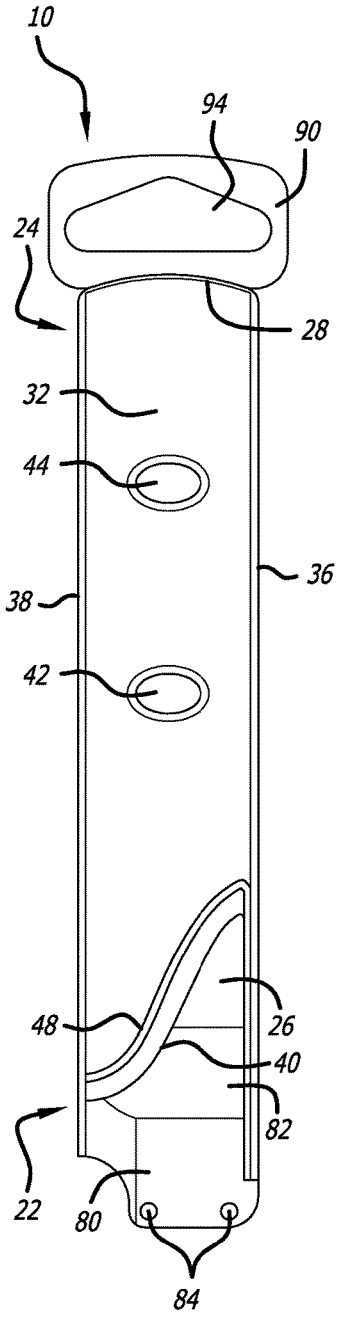
FIG. 23 is a front view of yet another example of a cutlery sheath according to the present disclosure.
Figure 25:
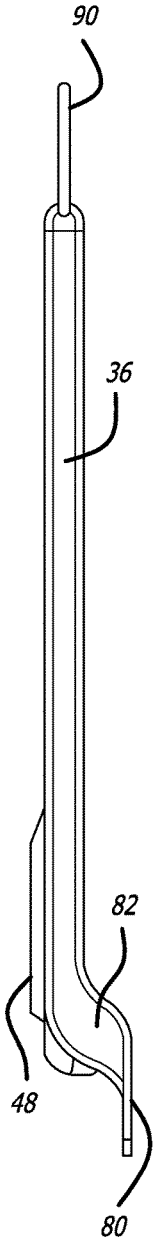
FIG. 25 is a left side view of the cutlery sheath shown in FIG. 23.

Yet another example of the present disclosure is shown in FIGS. 23-25. A sheath 10 includes a unitary body as previously discussed. The cut-away contoured portion 40 formed in the front wall 32 near the proximal end 22 includes a guard rail 48 formed on the front wall 32. The guard rail 48 aids in guiding the blade into the cavity 30 as a blade being positioned within the cavity will engage the guard rail 48 and be deflected into cavity 30. For example, the guard rail 48 will engage the tip of a blade as it is being positioned within the sheath to guide the blade tip into the cavity. As a result, improper positioning of the blade outside the cavity may be avoided.

The present invention has been described above with reference to exemplary embodiments. However, those skilled in the art having read this disclosure will recognize that changes and modifications may be made to the exemplary embodiments without departing from the scope of the present invention.

What is claimed is:

1. A protective sheath for removably securing a blade, the protective sheath comprising:

a unitary body having a proximal end and a distal end and comprising a cavity defined by a first wall, a second wall extending from the first wall, a third wall extending from the second wall, a fourth wall extending from the third wall, the first wall being parallel to the third wall and connecting the fourth wall to the second wall, the second wall connecting the first wall to the third wall, the third wall connecting the second wall to the fourth wall, and the fourth wall connecting the third wall to the first wall;

an end wall at the distal end of the unitary body;

an opening formed proximate the proximal end of the unitary body, the opening being configured to receive a blade into the cavity; and a curvilinear concave detent disposed in the second wall and defined by a curvature that extends downwardly into the cavity from a perimeter of the curvilinear concave detent toward an inner surface of the fourth wall, the perimeter of the curvilinear concave detent being contiguous with the second wall and extending from a position adjacent to but not contacting the end wall to a position adjacent to but not contacting the opening, the curvilinear concave detent including a first arm and an opposed second arm, the first arm and the opposed second arm each having a terminal edge defining a longitudinal aperture therebetween, wherein the longitudinal aperture is disposed entirely within the curvilinear concave detent and extends longitudinally along a longitudinal axis of the cavity.

2. The sheath of claim 1, wherein the unitary body is substantially rectangular.

3. The sheath of claim 1, wherein one of the second wall and the fourth wall includes an extension tab extending from the proximal end of the unitary body and having at least one aperture formed in the extension tab for receiving a cutlery handle securing member.

4. The sheath of claim 3, wherein the extension tab is laterally offset from one of the second wall and the fourth wall from which the tab extends.

5. The sheath of claim 3, wherein the extension tab comprises a lateral portion extending substantially transverse from one of the second wall and the fourth wall from which the extension tab extends and a flat portion extending from the lateral portion and substantially parallel to the second wall and the fourth wall from which the extension tab extends.

6. The sheath of claim 1, wherein the unitary body includes a display tab removably attached to the unitary body extending from the distal end of the unitary body and having formed therein an aperture for placement of the sheath on a display.

7. The sheath of claim 1, wherein the unitary body includes a guard rail configured to guide the blade into the cavity.

8. The sheath of claim 1, wherein the longitudinal aperture extends along a center line of the sheath.

* * * * *